US006637515B2

(12) United States Patent
Bishop et al.

(10) Patent No.: US 6,637,515 B2
(45) Date of Patent: Oct. 28, 2003

(54) METHOD AND APPARATUS FOR REDUCING PLUNGER SEAL WEAR ON AUTOMATIC CASING SWAB LIFT SYSTEMS

(75) Inventors: Ronald C. Bishop, Flora Vista, NM (US); David P. Gregg, New Philadelphia, OH (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 09/827,675

(22) Filed: Apr. 6, 2001

(65) Prior Publication Data

US 2002/0170718 A1 Nov. 21, 2002

(51) Int. Cl.[7] ..... E21B 43/00
(52) U.S. Cl. ..... 166/372; 166/70
(58) Field of Search ..... 166/372, 379, 166/177.3, 53, 70, 84.1, 75.14

(56) References Cited

U.S. PATENT DOCUMENTS 3,831,676 A * 8/1974 Brown et al. ..... 166/84.2
3,941,510 A * 3/1976 Morgan ..... 417/57
3,941,511 A * 3/1976 Morgan ..... 417/57
4,211,279 A * 7/1980 Isaacks ..... 166/106
4,278,278 A * 7/1981 Chambless et al. ..... 166/240
4,552,213 A * 11/1985 Boyd et al. ..... 166/375
4,629,004 A * 12/1986 Griffin ..... 166/170
5,253,713 A 10/1993 Gregg et al. ..... 166/372
5,755,290 A * 5/1998 Crichton ..... 166/379
5,893,417 A * 4/1999 Pizzolato ..... 166/377

FOREIGN PATENT DOCUMENTS

WO WO 019675 A2 * 12/2001

OTHER PUBLICATIONS

J. W. Cramer et al., "Automatic Casing Swabs: A Production System That Can Add Years of Productive Life to Wells", SPE 30981, Society of Petroleum Engineers, SPE Regional Meeting, Morgantown, W. Va.; Sep. 17–21, 1995, pp. 55–71.

* cited by examiner

*Primary Examiner*—David Bagnell
*Assistant Examiner*—T. Shor Bomar
(74) *Attorney, Agent, or Firm*—Rosenthal & Osha L.L.P.

(57) ABSTRACT

An apparatus is disclosed for improving plunger seal life on a casing swab system. The apparatus includes a diameter adapter disposed between an upper end of a wellbore casing and a lubricator adapted to receive a plunger therein. The diameter adapter is configured to provide a substantially constant internal diameter between the lubricator and the upper end of the casing. A method is also disclosed which includes retaining a casing swab plunger in a lubricator adapted to receive it for at least an amount of time sufficient to enable entrapped gas and fluids substantially to escape from the plunger seal material.

17 Claims, 6 Drawing Sheets

METHOD AND APPARATUS FOR REDUCING PLUNGER SEAL WEAR ON AUTOMATIC CASING SWAB LIFT SYSTEMS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of wellbore liquid lifting systems used in natural gas producing wellbores. More specifically, the invention relates to methods and apparatus for improving the life of plunger seals used with automatic casing swab liquid lift systems.

2. Background Art

Automatic casing swabs are known in the art for lifting liquids produced from earth formations from within wellbores intended primarily for natural gas production. Wellbores which produce natural gas often produce some liquids, either or both oil and water, and/or gas condensate. Some gas producing wellbores do not flow at sufficiently high rates to be able to entrain the produced liquids and thus remove them from the wellbore. For such wellbores, automatic casing swabs have proven to be a useful and economical way to remove produced liquids from the wellbore. A typical prior art automatic casing swab system is described, for example, in, J. W. Cramer et al., *Automatic Casing Swabs: A Production System That Can Add Years of Productive Life to Wells,* paper no. 30981, Society of Petroleum Engineers, Richardson, Tex. (1995). The typical prior art system includes a plunger adapted to travel along the inside of a casing in the wellbore. The casing has a plunger stop ("downhole stop") mounted therein, typically at a position just above the uppermost part of a producing ("perforated") interval in the casing. The perforated interval corresponds to the earth formations which produce gas and liquids into the wellbore. The plunger includes a traveling valve which enables the plunger to freely fall by gravity through the casing until it reaches the downhole stop. When the plunger reaches the downhole stop, the traveling valve is closed, and seals on an outer surface of the plunger engage the wall of the casing. Formation fluid pressure, including gas pressure, then builds up underneath the plunger and causes it to lift, along with wellbore liquids that are trapped above the plunger. Eventually, the plunger reaches a lubricator/trap disposed above control valves on the well disposed at the earth's surface. The lubricator/trap is adapted to hold the plunger in place therein until it is determined that it is again necessary to remove liquid from the wellbore.

A limitation of prior art automatic casing swab systems is that the seals which engage the internal wall of the casing are subject to rapid wear, damage, and/or deterioration from infusion of gas and fluids into the seal material. Failure to make a positive seal between the casing and the plunger limits or destroys the effectiveness of the plunger to lift liquid.

It is desirable to provide an automatic casing swab system having longer plunger seal life to increase effectiveness and to reduce operating costs.

SUMMARY OF THE INVENTION

One aspect of the invention is an apparatus for improving plunger seal life on a casing swab liquid lift system. The apparatus includes a diameter adapter disposed between an upper end of a wellbore casing and a lubricator adapted to receive a plunger therein. The diameter adapter is configured to provide a substantially constant internal diameter between the lubricator and the upper end of the casing.

One embodiment of the diameter adapter includes an adapter flange having an internal bore sized at its lower end to fit over the upper end of the casing, and at its other end having an internal diameter substantially the same as the internal diameter of the casing. Another embodiment of the diameter adapter includes an adapter sleeve having an internal diameter substantially the same as an internal diameter of the wellbore casing. The adapter sleeve is coupled to a flange. The flange is adapted to seat in a tubing spool coupled to a wellhead. The adapter sleeve has a length selected to enable seating of the flange in the tubing spool and to position a lower end of the sleeve proximate the upper end of the casing.

A method according to another aspect of the invention includes inserting into a wellhead disposed at an upper end of a wellbore casing a diameter adapter. The adapter is disposed between the upper end of the wellbore casing and a lubricator adapted to receive a plunger therein. The adapter is configured to provide a substantially constant internal diameter between the lubricator and the upper end of the casing.

A method according to another aspect of the invention includes retaining a swab plunger in a lubricator adapted to receive it for at least an amount of time to enable entrapped gas and fluids to escape from the plunger seal material.

Other aspects and advantages of the invention will be apparent from the following description and the appended claims.

DETAILED DESCRIPTION

Figure 1A:
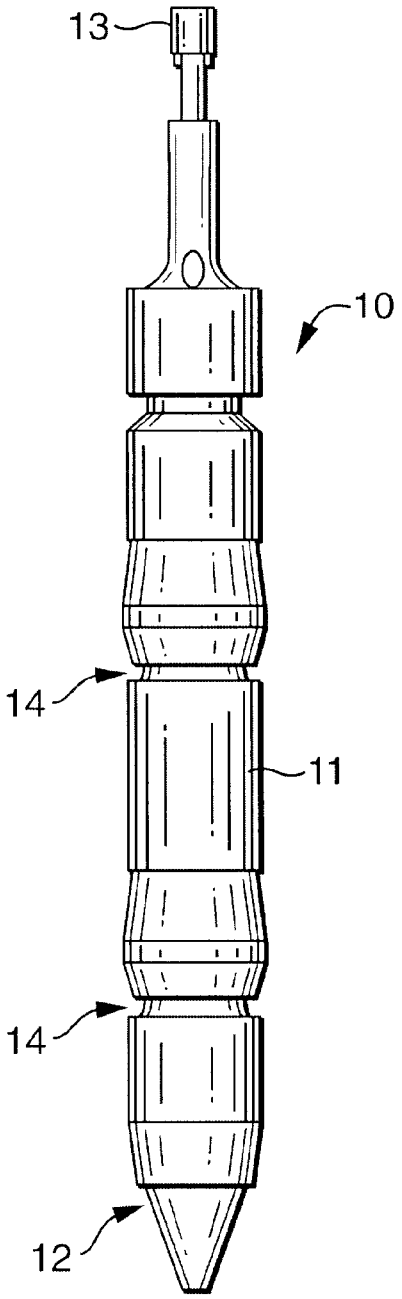
FIG. 1A (PRIOR ART)
FIGS. 1A and 1B show a typical automatic casing swab plunger which can be used with the invention.
Figure 1B:
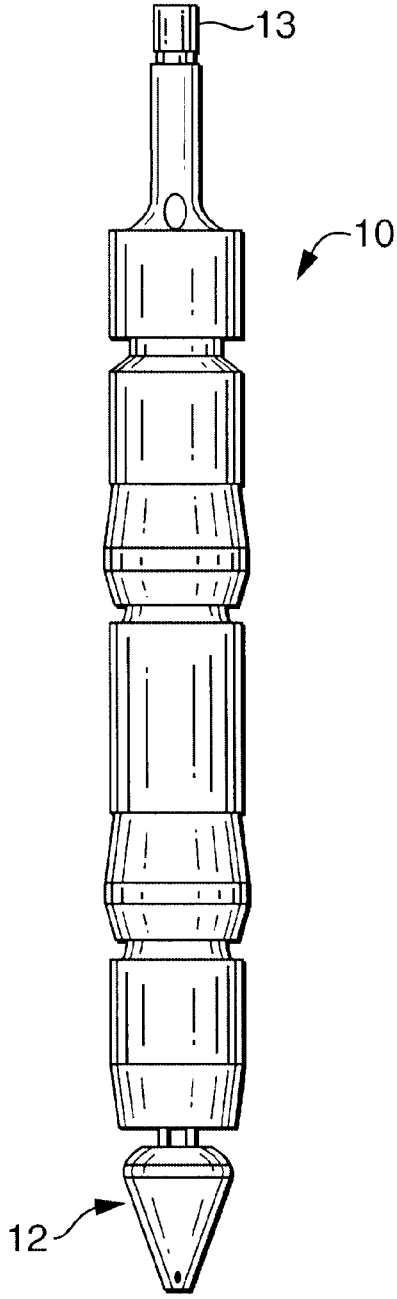
FIG. 1B (PRIOR ART)

As explained in the Background section herein, typical automatic casing swab systems are described, for example, in J. W. Cramer et al., *Automatic Casing Swabs: A Production System That Can Add Years of Productive Life to Wells*, paper no. 30981, Society of Petroleum Engineers, Richardson, Tex. (1995). Referring to FIG. 1A a typical casing plunger 10 includes a mandrel 11 that includes seal grooves 14 on its exterior surface. The grooves 14 are intended to provide a means to retain cup type seals (not shown in FIG. 1A). As is known in the art, the seals (not shown) have an external diameter selected to seal against a particular inside diameter wellbore casing (not shown in FIG. 1A), while enabling the plunger 10 to move within the casing (not shown) by gravity and by trapped pressure. The plunger 10 also includes a traveling valve 12, shown in FIG. 1A in its closed position. The traveling valve 12 is closed when the plunger 10 reaches a downhole stop (20 in FIG. 2). The traveling valve 12 is opened when an upper operating latch 13 reaches a corresponding actuator (not shown) disposed inside a lubricator affixed to a wellhead, as will be described and shown in more detail. The traveling valve 12 is shown in its opened position in FIG. 1B. When the traveling valve 12 is opened, the plunger 10 is able to fall by gravity through a wellbore casing (not shown in FIG. 1A or 1B) until it reaches the down hole stop (not shown in FIG. 1A or 1B). Fluids which enter the wellbore may flow freely through the opened traveling valve 12 during the plunger 10 descent through the casing.

Figure 2:
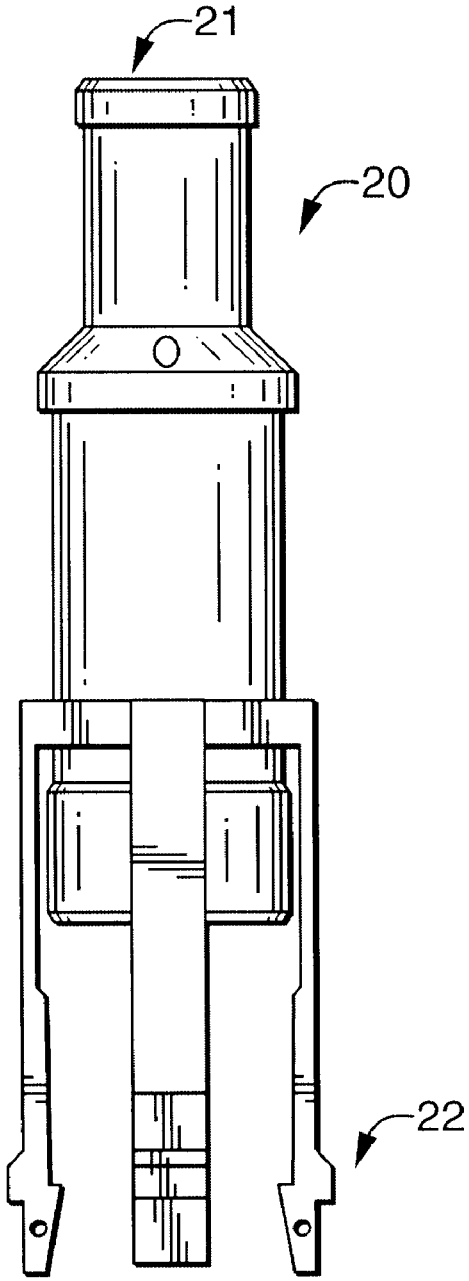
FIG. 2 (PRIOR ART)
FIG. 2 shows a typical plunger stop used with a plunger such as shown in FIGS. 1A and 1B.

A typical downhole stop is shown at 20 in FIG. 2. The downhole stop 20 includes collet fingers 22 or similar retention device to latch the downhole stop 20 in a space disposed between selected joints of casing (not shown) in the wellbore. Typically the axial position along the wellbore of the selected joints is above the uppermost perforation (not shown) in the wellbore. The stop includes a landing 21 for the plunger (10 in FIG. 1A). When the plunger (10 in FIG. 1A) reaches the landing, the traveling valve (12 in FIG. 1A) is closed. The seals (not shown) in the grooves (14 in FIG. 1A) then seal against the interior wall of the casing (not shown in FIG. 2). Fluids entering the wellbore then may build up pressure underneath the plunger 10 causing it to rise in the casing. Liquids in the wellbore disposed above the plunger 10 are trapped by the closed traveling valve 12 and the seals (not shown), and are thus lifted as the plunger 10 is pushed up the casing by the pressure of entering fluids below the plunger 10. Eventually the plunger 10 reaches the surface, where the lifted liquids may be discharged through an orifice in the lubricator (not shown in FIG. 2) or other similar arrangement.

Figure 3B:
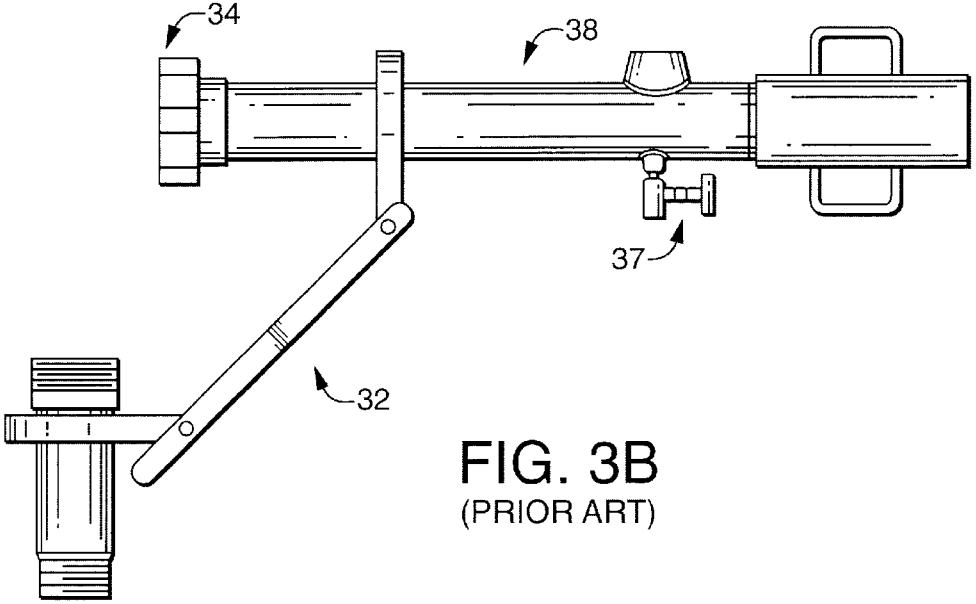
FIG. 3B (PRIOR ART)
FIGS. 3A and 3B show a typical prior art lubricator/plunger latch used with a plunger such as shown in FIGS. 1A and 1B.
Figure 3A:
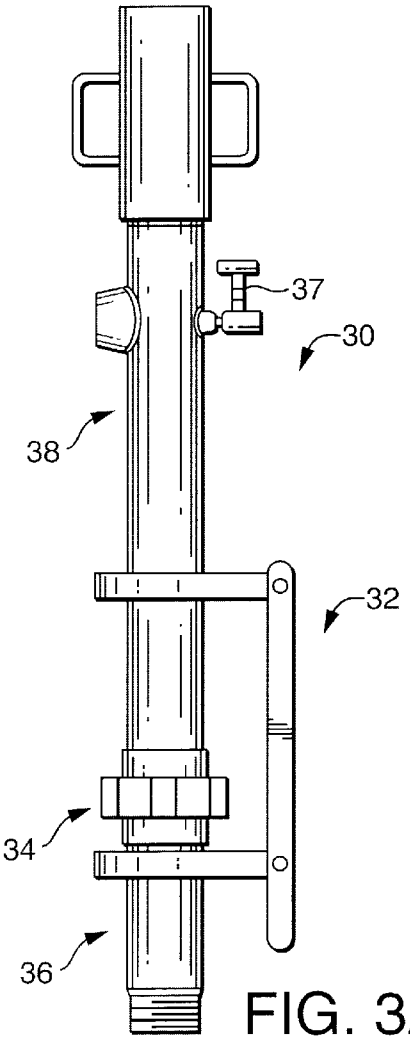
FIG. 3A (PRIOR ART)

The upward motion of the plunger 10 is stopped by a device coupled to the top of the wellhead called a lubricator. A typical lubricator is shown in FIG. 3A at 30. This example lubricator 30 includes an upper riser 38 which may include a latch (not shown) or other device known in the art for catching and retaining the plunger (10 in FIG. 1A) after it reaches the upper limit of travel and the traveling valve (12 in FIG. 1A) is reopened. The upper riser 38 may be attached to a wellhead adapted 36 by a threaded coupling 34 of any type known in the art, such as a hammer union. The wellhead adapter 36 enables the lubricator 30 to be coupled to the top of a wellhead (not shown in FIG. 3A). This example lubricator 30 includes a hinged coupling 32 which enables the upper riser 38 to be uncoupled from the wellhead adapter 36, and enables the upper riser 30 to be swiveled or rotated out of the way to enable servicing the plunger (10 in FIG. 1A). The upper riser 38 is shown uncoupled and swiveled out of the way for service operations in FIG. 3B. Preferably the lubricator 30 includes therein an orifice 37 adapted to discharge produced natural gas and other wellbore fluids at a controlled rate. Providing the orifice 37, as is known in the art, limits the upward velocity of the plunger (10 in FIG. 1A) to minimize damage thereto.

The lubricator 30 may include therein any form of controllable latch (not shown) known in the art for selectively retaining the plunger (10 in FIG. 1A) inside the lubricator 30 until it is desired to return the plunger to the down hole stop (20 in FIG. 2) to again lift liquids out of the well. As will be further explained, the life of the plunger seals may be extended by retaining the plunger (10 in FIG. 1A) in the lubricator 30 for at least a selected time.

Figure 4A:
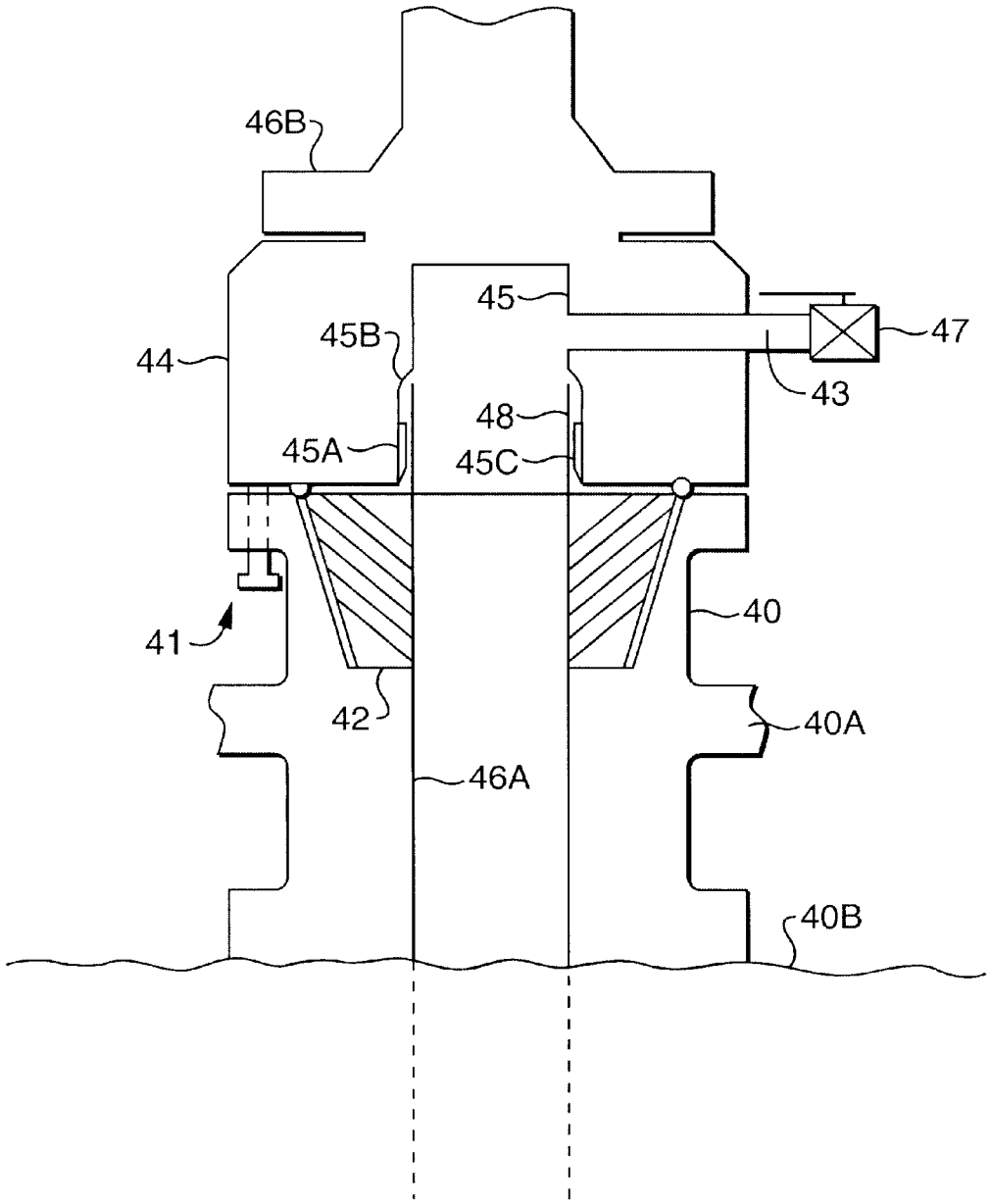
FIG. 4A shows one embodiment of an adapter according to the invention which is coupled to a casing head.

Having explained the relevant parts of an automatic casing swab system, the invention and its relationship to automatic casing swab systems will now be explained. FIG. 4A shows a typical configuration of a wellbore near the earth's surface 40B. The wellbore includes therein a casing 46A which is hung by a casing hanger 42 inside a braden head 40. The braden head 40 may include therein a side port or opening 40A for affixing a casing valve (not shown) or the like to control and/or vent any fluid pressure which may build in an annular space (not shown) between the casing 46A and any surface or conductor pipe (not shown in FIG. 4A) disposed below the braden head 40. Typically, the casing 46A will include a "stub" 48 or similar protrusion above the casing hanger 42. In the invention, it has been determined that the cup seals (not shown) on the plunger (10 in FIG. 1A) are subject to rapid wear and/or damage when the plunger (10 in FIG. 1A) passes through the top of the stub 48. The damage and/or wear may result from changes in internal diameter between wellhead equipment, such as master valve 46B, and the casing 46A. Generally, this aspect of the invention includes an internal diameter adapter disposed in the wellhead equipment between the lubricator (30 in FIG. 3A) and the stub 48. Various embodiments of the invention provide a substantially constant internal diameter within the wellhead equipment which substantially matches the internal diameter of the well casing.

The embodiment of the invention shown in FIG. 4A includes an adapter flange 44 which is configured to match the internal diameter of the casing 46A to the wellhead equipment above, including master valve 46B. The adapter flange 44 in this embodiment is configured sealingly coupled to the braden head 40 and to the master valve 46B such as by bolts 41 or any similar wellhead equipment coupling known in the art. Matching internal diameters of the casing 46A and the wellhead equipment above, such as master valve 46B, is accomplished by forming an internal bore 45 in the adapter flange 44 which has an internal diameter above the stub 48 substantially equal to the internal diameter of the casing 46A. A lower portion 45A of the internal bore of the adapter flange 44 has an internal diameter selected to fit outside the casing 46A. A seal 45C may be included in between the lower bore portion 45A and the casing 46A to reduce the possibility of fluid leaks. Preferably, the diameter transition between the bore 45 and the lower portion 45A includes a bevel or taper 45B. In this embodiment, the adapter flange includes a wing port 43 in fluid communication with the interior of the casing 46A, and to which may be coupled a valve 47 to selectively close the wing port 43. The wing port 43 may be provided in some embodiments of the adapter flange 44 as a well control device. In the event the plunger (10 in FIG. 1A) becomes stuck in the master valve 46B, thereby preventing it from being closed, the well operator may elect to "kill" the well by pumping fluid in through the wing port 43 of sufficient hydrostatic head to prevent more fluid from entering the wellbore from earth formations below (not shown). Other embodiments of the adapter flange 44 may not include the wing port, depending on the type of wellhead equipment used on any particular well.

The embodiment of the adapter flange 44 shown in FIG. 4A may be machined or formed from a single piece of steel or other suitable material, but this is not intended to limit the scope of the invention. Any other construction which provides a substantially constant internal diameter to the top of the casing stub 48 may also be used in other embodiments of an adapter flange.

Figure 4B:
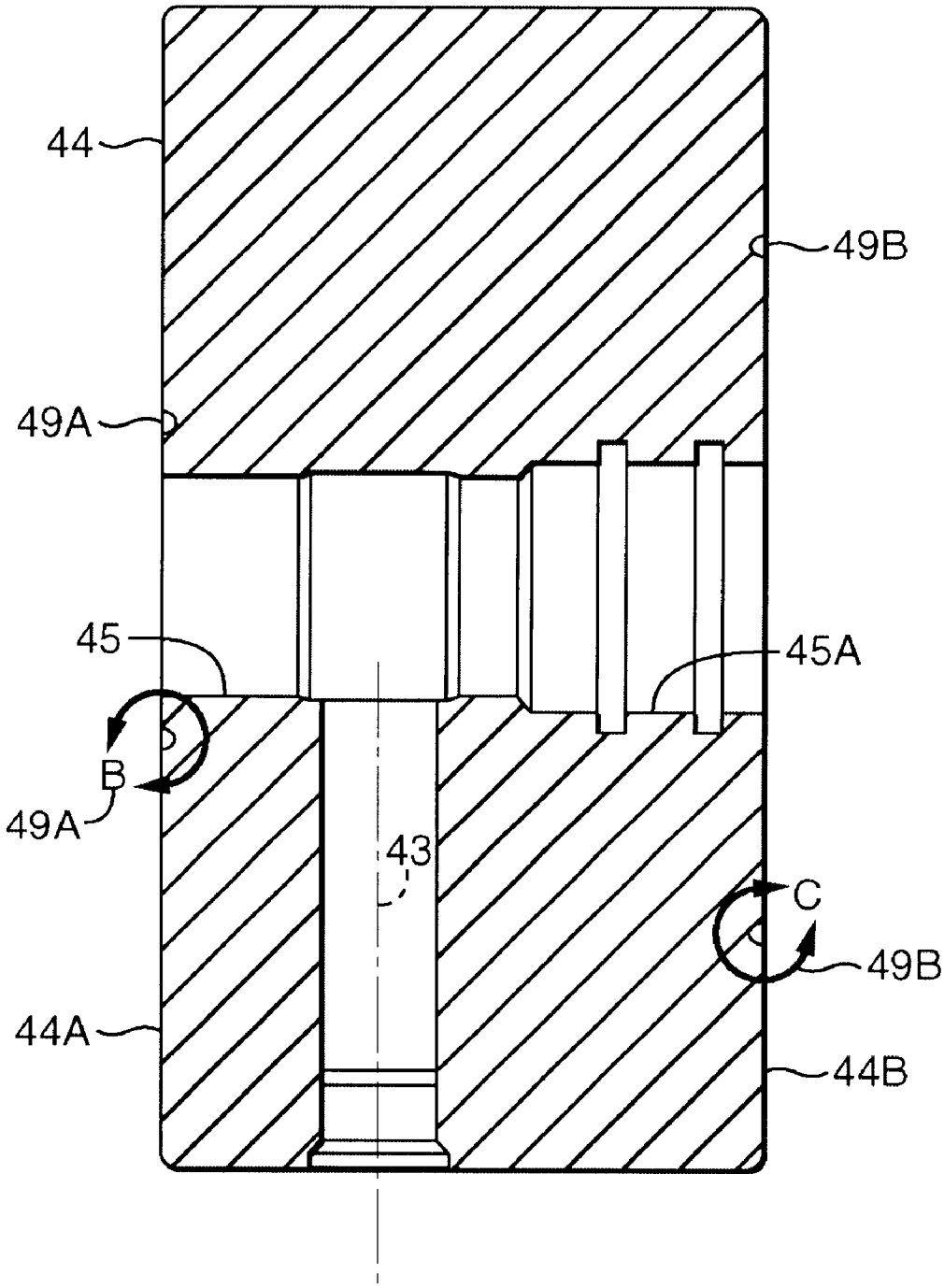
FIG. 4B shows a cross-sectional view of the example embodiment adapter shown in FIG. 4A.

A cross sectional view of the adapter flange 44 is shown in FIG. 4B. The flange 44 preferably includes on its upper 44A and lower 44B surfaces, seal grooves 49A and 49B, respectively, for including therein a ring-type fluid seal (not shown) of any type known in the art for sealing flange-type couplings.

Figure 5:
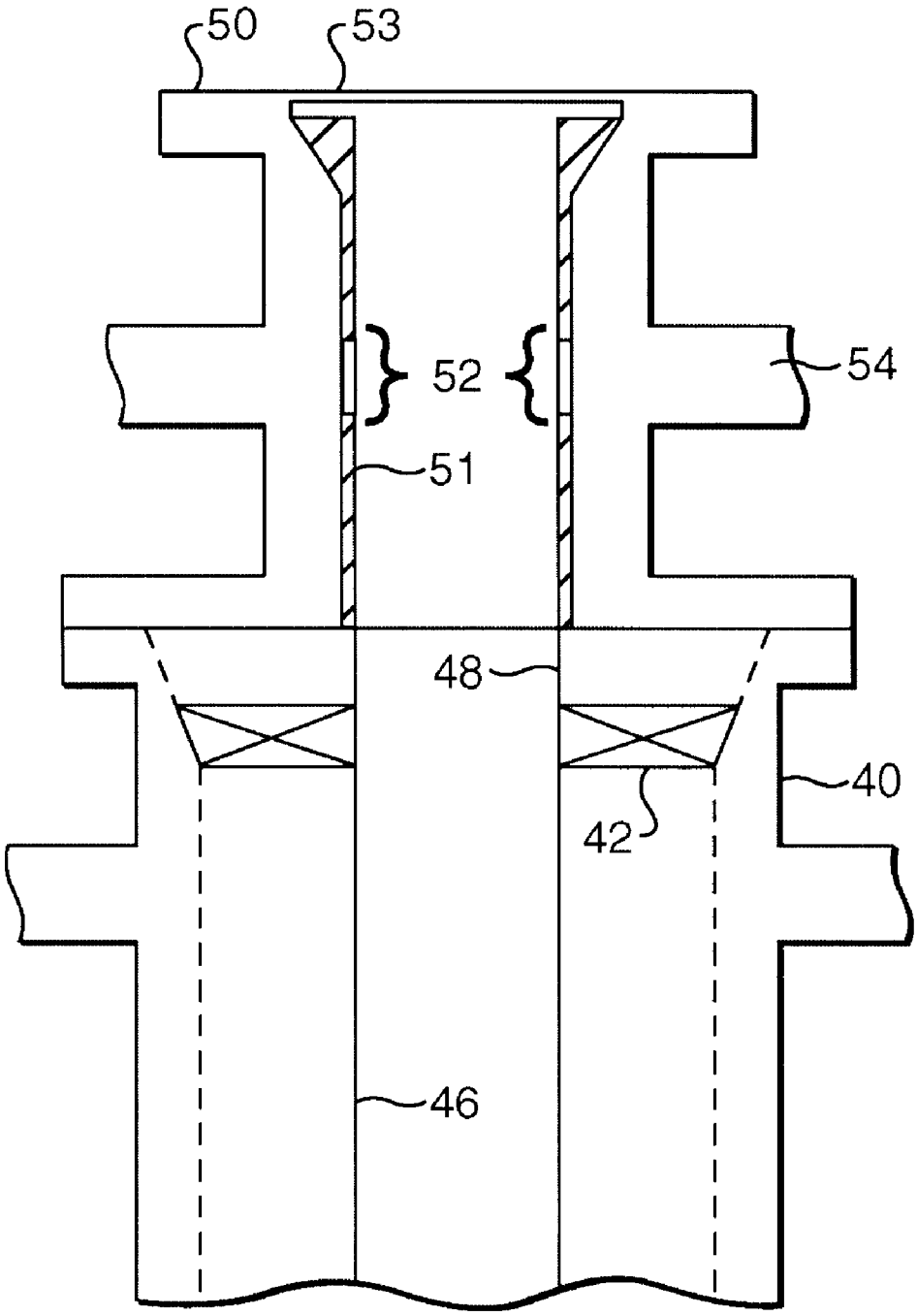
FIG. 5 shows another embodiment of an adapter according to the invention.

Another embodiment of a diameter adapter according to this aspect of the invention is shown in FIG. 5. The braden head 40 shown in FIG. 5 includes thereon a spool 50 or similar device. In this example, the spool 50 is a tubing spool typically used to hang a production tubing inside a casing. The type of spool used in any form of this embodiment of the invention will depend on the diameter of the casing (46A in FIG. 4A). Note that in a wellbore which uses a casing swab, typically no production tubing is present therein. An adapter sleeve 51 is coupled at one end to a flange 53 or similar hanging instrument to "hang off" the adapter sleeve 51 in the tubing spool 50. Preferably the adapter sleeve 51 includes therein openings or perforations 52 to enable fluid communication from the interior of the sleeve 51 to a casing wing valve port 54 in the spool 50. The length of the sleeve 51 should be such that the sleeve 51 hangs properly in the spool 50, and the lower end of the sleeve 51 is proximate the upper end of the casing stub 48.

Preferably the openings or perforations 52 are formed to have a substantially smooth surface on the interior wall of the sleeve 51, so that wear and damage to the plunger seals (not shown in FIG. 5) are minimized. Methods for forming such perforations and surface are known in the art.

The various embodiments of a diameter adapter according to the foregoing aspect of the invention reduce the number of sharp edges and rapid changes in diameter inside wellhead equipment and can improve the life of plunger seals on a casing swab plunger.

In another aspect of the invention, it has been determined that plunger seal life may be improved by providing a selected "rest time" where the plunger (10 in FIG. 1A) is held in place inside the lubricator (30 in FIG. 3A) before being allowed to return down the casing (46A in FIG. 4A). Allowing the plunger to "rest" (remain latched) in the lubricator enables gas and other fluids which may become entrapped in the plunger seal material to be released therefrom. Releasing entrapped gas and fluids may reduce blistering of the plunger seals. Generally speaking, the amount of time needed to keep the plunger latched in the lubricator will depend on the type of seal material and on the pressure at the wellhead. A type of seal material used by Regal International, Inc., Corsicana, Tex., to make a seal sold by them under trade name "extended lip jet cup, 4½ inch, part no. 80-9830" was tested to determine suitable "rest" times. It has been determined that a preferred amount of plunger "rest" time for various wellhead pressures is shown in the following table when using this particular seal material.

| Wellhead Pressure (psi) | Minimum Latching Time (minutes) |
|---|---|
| 50 | 75 |
| 100 | 120 |
| 150 | 150 |
| 200 | 200 |
| 250 | 220 |
| 300 | 240 |
| 350 | 280 |
| 400 | 300 |

In a method according to this aspect of the invention, an amount of time that the plunger (10 in FIG. 1A) is latched in the lubricator (30 in FIG. 3A) is set to at least an amount which enables the entrapped gas and liquids in the plunger seal material substantially to escape from the seal material. Longer in-latch times may be used in any particular plunger cycle, depending on the rate at which liquids must be removed from the wellbore and on the lifting capacity of the plunger (10 in FIG. 1A), as long as the in-latch time is at least enough to enable most of the entrapped gas and fluids to escape from the seal material. As is known in the art, the lifting capacity of the plunger depends on the differential pressure that can be developed in the wellbore and on the diameter of the plunger. It should be noted that the preferred minimum times shown in the table above are related to the specific material described herein. Other materials may have different preferred minimum in-latch times. Also as previously explained, the minimum in-latch time may depend on the well pressure. Accordingly, the above times are meant to serve only as examples with respect to one type of seal material, and are not meant to limit the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for improving plunger seal life on a casing swab system, comprising:

a diameter adapter disposed between an upper end of a wellbore casing and a lubricator adapted to receive a plunger therein, the adapter configured to provide a substantially constant internal diameter between the lubricator and the upper end of the casing.

2. The apparatus as defined in claim 1 wherein the diameter adapter comprises an adapter flange configured to attach to a wellhead proximate the upper end of the casing, the adapter flange having an internal bore including a lower end adapted to fit over the upper end of the casing and an upper end having an internal diameter substantially the same as an internal diameter of the wellbore casing.

3. The apparatus as defined in claim 2 wherein the adapter flange comprises a wing port in hydraulic communication with the internal bore, the wing port adapted to couple to a valve.

4. The apparatus as defined in claim 1 wherein the diameter adapter comprises an adapter sleeve having an internal diameter substantially the same as an internal diameter of the wellbore casing, the adapter sleeve coupled to a flange, the flange adapted to seat in a spool coupled to a wellhead, the adapter sleeve having a length selected to enable seating of the flange in the tubing spool and to position a lower end of the sleeve proximate the upper end of the casing.

5. The apparatus as defined in claim 4 wherein the adapter sleeve comprises openings in a wall thereof, the openings providing hydraulic communication between an interior of the sleeve and a wing port in the spool.

6. A method for improving plunger seal life in an automatic casing swab system, comprising: allowing a plunger to lift into a lubricator adapted to receive the plunger therein; and retaining the plunger in the lubricator for at least a time dependent on wellhead pressure to enable entrapped gas and fluids substantially to escape from a plunger seal material.

7. The method as defined in claim 6 further comprising: inserting into a wellhead disposed at an upper end of a wellbore casing a diameter adapter, the adapter disposed between the upper end of the wellbore casing and the lubricator, the adapter configured to provide a substantially constant internal diameter between the lubricator and the upper end of the casing.

8. The method as defined in claim 7 wherein the diameter adapter comprises an adapter flange configured to attach to a wellhead proximate the upper end of the casing, the adapter flange having an internal bore including a lower end adapted to fit over the upper end of the casing and an upper end having an internal diameter substantially the same as an internal diameter of the wellbore casing.

9. The method as defined in claim 8 wherein the adapter flange comprises a wing port in hydraulic communication with the internal bore, the wing port adapted to couple to a valve.

10. The method as defined in claim 7 wherein the diameter adapter comprises an adapter sleeve having an internal diameter substantially the same as an internal diameter of the wellbore casing, the adapter sleeve coupled to a flange, the flange adapted to seat in a tubing spool coupled to a wellhead, the adapter sleeve having a length selected to enable seating of the flange in the tubing spool and to position a lower end of the sleeve proximate the upper end of the casing.

11. The method as defined in claim 10 wherein the adapter sleeve comprises openings in a wall thereof, the openings providing hydraulic communication between an interior of the sleeve and a casing wing port in the tubing spool.

12. A method for improving plunger seal life on a casing swab system, comprising:

inserting into a wellhead disposed at an upper end of a wellbore casing a diameter adapter, the adapter disposed between the upper end of the wellbore casing and a lubricator adapted to receive a plunger therein, the adapter configured to provide a substantially constant internal diameter between the lubricator and the upper end of the casing.

13. The method as defined in claim 12 wherein the diameter adapter comprises an adapter flange configured to attach to a wellhead proximate the upper end of the casing, the adapter flange having an internal bore including a lower end adapted to fit over the upper end of the casing and an upper end having an internal diameter substantially the same as an internal diameter of the wellbore casing.

14. The method as defined in claim 13 wherein the adapter flange comprises a wing port in hydraulic communication with the internal bore, the wing port adapted to couple to a valve.

15. The method as defined in claim 12 wherein the diameter adapter comprises an adapter sleeve having an internal diameter substantially the same as an internal diameter of the wellbore casing, the adapter sleeve coupled to a flange, the flange adapted to seat in a tubing spool coupled to a wellhead, the adapter sleeve having a length selected to enable seating of the flange in the tubing spool and to position a lower end of the sleeve proximate the upper end of the casing.

16. The method as defined in claim 15 wherein the adapter sleeve comprises openings in a wall thereof, the openings providing hydraulic communication between an interior of the sleeve and a casing wing port in the tubing spool.

17. The method as defined in claim 12 further comprising: allowing a plunger to lift into the lubricator; and retaining the plunger in the lubricator for at least a time adapted to enable entrapped gas and fluids substantially to escape from a plunger seal material.

* * * * *